United States Patent [19]

Balzli et al.

[11] Patent Number: 4,984,770

[45] Date of Patent: Jan. 15, 1991

[54] APPARATUS FOR PARTIAL TEMPERING OF ROLLED WIRE PRODUCTS MADE OF STEEL

[75] Inventors: Samuel Balzli, Rothenburg; Werner Syfrig, Luzern, both of Switzerland

[73] Assignee: Von Moose Stahl AG, Luzern, Switzerland

[21] Appl. No.: 236,358

[22] PCT Filed: Nov. 19, 1987

[86] PCT No.: PCT/CH87/00154

§ 371 Date: Jul. 22, 1988

§ 102(e) Date: Jul. 22, 1988

[87] PCT Pub. No.: WO88/03959

PCT Pub. Date: Jun. 2, 1988

[30] Foreign Application Priority Data

Nov. 21, 1986 [CH] Switzerland ..... 4667/86

[51] Int. Cl.[5] ..... C21D 9/56

[52] U.S. Cl. ..... 266/106; 266/115

[58] Field of Search ..... 148/12 B, 145, 152, 148/153; 266/106, 115, 116

[56] References Cited

U.S. PATENT DOCUMENTS

| | | | |
|---|---|---|---|
| 4,016,009 | 4/1977 | Economopoulos et al. | 148/12 B |
| 4,108,695 | 8/1978 | Paulitsch et al. | 148/12 B |
| 4,168,993 | 9/1979 | Wilson et al. | 148/12 B |
| 4,236,551 | 12/1980 | Worgt et al. | 148/12 B |

FOREIGN PATENT DOCUMENTS

| | | | |
|---|---|---|---|
| 1262323 | 9/1968 | Fed. Rep. of Germany . | |
| 1452343 | 2/1969 | Fed. Rep. of Germany . | |
| 1240541 | 11/1972 | Fed. Rep. of Germany . | |
| 2829428 | 4/1979 | Fed. Rep. of Germany . | |
| 154614 | 4/1982 | German Democratic Rep. | 148/12 B |
| 405040 | 7/1966 | Switzerland . | |
| 1128350 | 9/1968 | United Kingdom . | |

OTHER PUBLICATIONS

Simon et al., "Tempcore: A New Process for the Production of High-Quality Reinforcing Bars", Iron and Steel Engineer, Mar. 1984, pp. 53–57.

Economopoulos et al., "Application of the Tempcore Process to the Fabrication of High Yield Strength Concrete-Reinforcing Bars", Steel Furnace Monthly, Feb. 1977, pp. 57–73.

*Primary Examiner*—S. Kastler

*Attorney, Agent, or Firm*—Browdy and Neimark

[57] ABSTRACT

The partial tempering of rolled wire (WD) takes place in a quenching chamber (2), which is disposed following the winding layer (1). Thus work can proceed at the typical rolling speeds of up to 120 m/s, and the annular disposition of the wire in the quenching chamber makes it possible for the cooling line required for tempering to be much shorter. The rolled wire (WD) is shaped into loops (S) in the state in which it is still hot from the rolling mill, and as a result excessuve abrasion of the winding layer (1) does not occur, and the cooled wire has no strains, because the hardened steel does not have to be bent.

3 Claims, 2 Drawing Sheets

APPARATUS FOR PARTIAL TEMPERING OF ROLLED WIRE PRODUCTS MADE OF STEEL

BACKGROUND OF THE INVENTION

1. Field of the Invention

The present invention relates to the partial tempering of rolled wire products made of steel.

2. The Prior Art

In the production of bars, quenching directly from the rolling heat, and thus partially tempering the steel, is known. With bars of finite lengths, the bars, after being cut, are moved axially and in so doing are treated with a cooling medium. This method has gained wide application and has proved itself many times.

In the partial tempering of rolled wire, this method cannot be used without great difficulty, because at the typical rolling speed and with a necessary cooling period of from 0.5 to 1 s, the cooling line can be up to 120 m long. Such a long cooling line is vulnerable to malfunction, and both an initial and a final length of the rolled product remain uncooled, so there is considerable waste.

The term "partial tempering" is understood to mean a process that affects only the peripheral region of the tempering material, in which the peripheral zone is converted completely to martensite and after the quenching process is ended is annealed again by the residual heat present in the center of the cooling material. The important factor is the peripheral zone is converted completely and homogeneously to annealed martensite.

It is known for wires to be cooled down first from the heat of the rolling mill, and then delivered to a winding layer. Examples of this are described in British patent application No. 1,128,35, German examined patent application No. 1,262,323 and German unexamined patent application No. 1,452,343. Such methods were offered in order to improve the cold drawing capability. The hot-rolled wire here is subjected to an intermediate-stage tempering, and martensite formation during the cooling process is very consciously avoided, because it considerably impairs the drawing capability.

In contrast to that, German unexamined patent application No. 2,829,428 discloses an apparatus for producing wires usable for concrete reinforcing bars. Here, following the final rolling pass, cooling to approximately 750° C. is supposed to take place, so that after the following winding layer the cooling can be completed to 600° to 500°. As indicated in this published reference, a complete conversion of the peripheral region to a martensitic structure is not sought; this is dictated by the first cooling stage, in which the precipitation of perlite already takes place, and only the remaining amount of austenite can be converted into martensite.

SUMMARY OF THE INVENTION

Even if these disadvantages were accepted as a necessary compromise, the great lengths involved present still further problems, because the wires have to be shaped into wire windings by winding layers immediately following the cooling, or in other words when their surface is hardened. Accordingly, the winding layer must work against great resistance, and must therefore be equipped with heavy-duty motors. On the other hand, the hardened surface acts like a file and quickly wears down the equipment parts required. Finally, the internal strains generated by the cooling and subsequent bending have a deleterious effect on laying the wire uniformly, which can cause problems and disrupt operation during an ensuing processing operation.

It is therefore the object of the invention to devise a method and an apparatus for performing the method with which the above-mentioned disadvantages can be overcome, and with which rolled wire products can be partially tempered with equal ease, and with a quality comparable to that of bars.

It is an object of the invention to produce a rolled wire product in which the peripheral region comprises fully annealed martensite, so as to attain high final strength in combination with good fatigue properties, high durability and conductability, with favorable corrosion resistance.

According to a preferred embodiment a method is provided for partial tempering of rolled wire products made of steel from the rolling heat by quenching with a cooling medium, wherein the warm wire, after the final rolling pass, is delivered to a winding layer and is not quenched until after being shaped into wire windings.

BRIEF DESCRIPTION OF THE DRAWINGS

The invention will be described in detail below in terms of exemplary embodiments shown in the drawing, in which FIG. 1, a schematic illustration of a winding layer having a succeeding quenching chamber, which is shown partially in section.

DETAILED DESCRIPTION OF THE PREFERRED EMBODIMENTS

Figure 1:
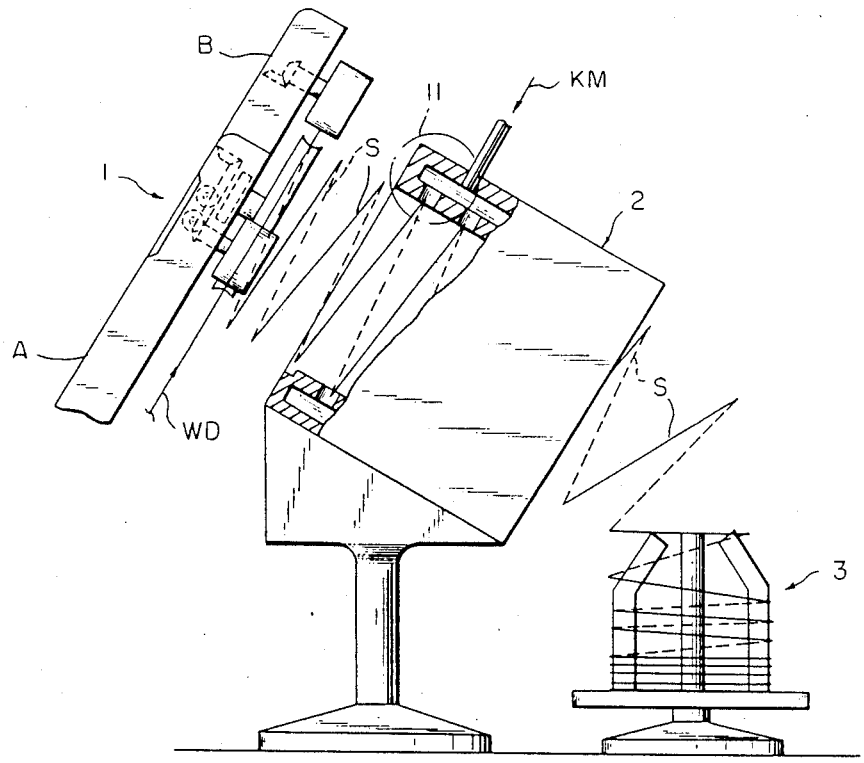

In FIG. 1, A is the carrier for the pivot arm B of a winding layer 1. This winding layer 1 is followed by the quenching chamber 2 and finally by the wire reel 3. While the winding layer 1 and wire reel 3 are known components in wire production, as shown for instance in Swiss patent application No. 405040, the quenching chamber 2 is novel, both per se and in its embodiment.

As FIG. 1 clearly shows, the winding layer 1 lays loops of wire S comprising the wire WD hot from the rolling mill. While the windings are shown far apart from one another, they may in actuality be located close together, in such a way that with a short cooling line, a long zone of the rolled wire can be cooled, as the following example shows:

| | |
|---|---|
| Wire diameter | 10 mm |
| Cooling time | 0.5 s |
| Rolling speed | 60 m/s |
| Distance between the windings | 5 cm |

In this case, a length of 40 cm for the quenching chamber 2 is sufficient.

Figure 2:
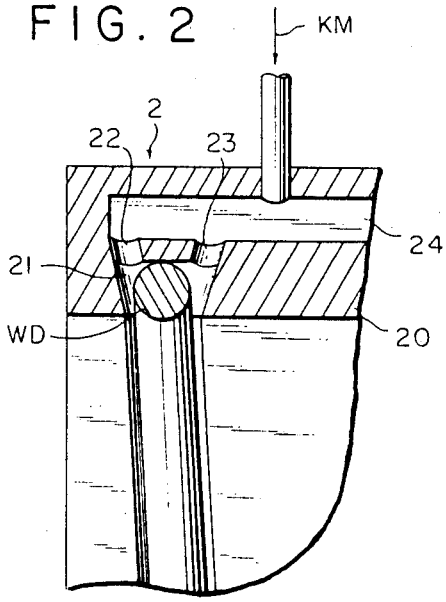
FIG. 2, an enlarged detail of area II in FIG. 1.

The embodiment of the quenching chamber 2 may be as shown in FIG. 2, with the wire coil guided in helically disposed grooves 21 present in the inner wall 20 of the tubular quenching chamber 2. With at least one row of openings 22, 23 the grooves 21 communicate with an annular chamber 24, which is supplied from outside with the cooling medium.

Figure 3:
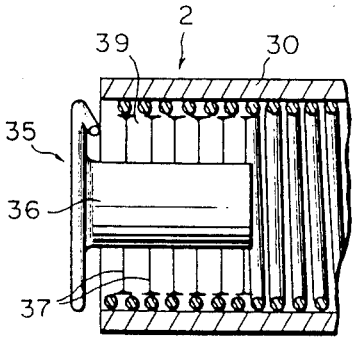
FIG. 3, a sectional view of a quenching chamber in another embodiment.

In another embodiment as shown in FIG. 3, there are not only an outer guide wall 30 but also an inner guide element 35. The outer guide wall 30 may be embodied similarly to the inner wall 20 of FIG. 2 with grooves 21 and openings 22, 23 leading to an annular chamber 24, not shown, or the grooves may be embodied as simple fluting, because they need not perform the task of guiding the wire coil all by themselves. The inner guide wall 35 includes a cylindrical hub portion 36 with helically disposed support elements 37, which form an at least approximately closed bearing surface for the wire coil.

The cooling medium, for instance a mixture of gas and water, may be injected through the outer guide wall 30, or supplied directly into the annular chamber 39 between the outer guide wall 30 and the inner guide wall 37 and inner guide element 35.

Depending on the intensity of the cooling, or on the selection of the basic material, rolled wire having the following characteristics can be produced for particular applications: concrete reinforcing steels having a yield strength of 400 to 600 $N/mm^2$; tempering steels having a yield strength of 600 to 900 $N/mm^2$; and special steels and wear-resistant steels having a yield strength of over 900 $N/mm^2$.

These high qualities can be attained by the method according to the invention at the usual rolling speeds, or in other words without reducing the rolling output. The winding layer is subjected to normal wear, since the wearing forces known in partially tempered steel do not arise because of the subsequent cooling. The strains in the reeled wire are uniform, because the cooling takes place in the reeled wire, and the hardened steel is not subjected to a laying operation. The losses at the beginning and end of the wire are practically zero, because the cooling takes place continuously in uninterrupted operation.

Figure 4:
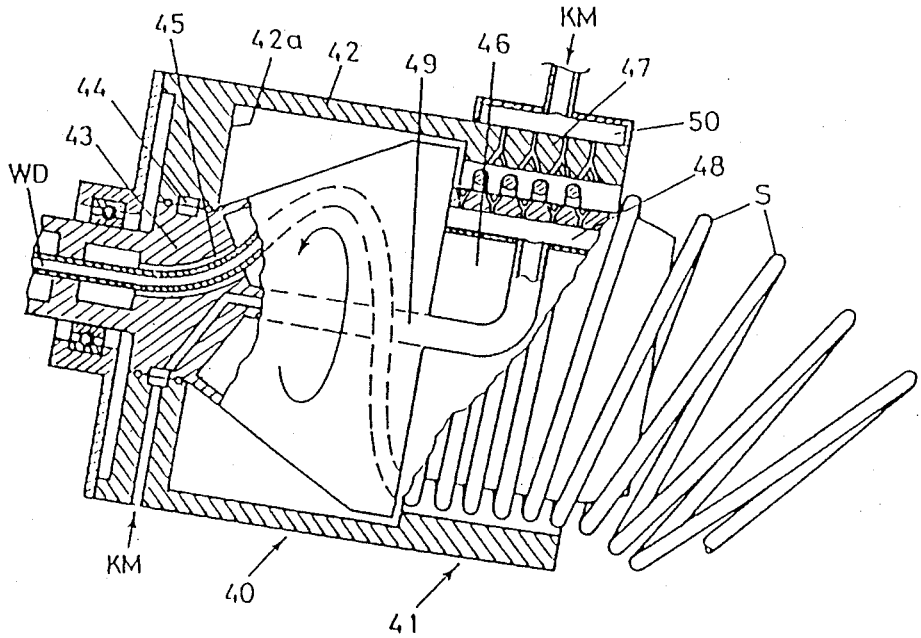
FIG. 4, a sectional view of a winding layer having an integrated quenching chamber.

A winding layer 40 having an integrated quenching chamber 41 is shown in section in FIG. 4. A rotor 43 with a laying tube 45 is rotatably supported on the end plate **42*a* of an outer housing 42. The cooling medium KM is introduced radially into the end plate 42*a* and delivered via a cooling medium line 49, via a pair of encompassing grooves 44 in the end plate 42*a* and in the rotor 43, to the nozzle chamber 48 in an inner housing 46**.

A nozzle chamber 50, to which the cooling medium is supplied directly, is also located on the outer housing 47 of the quenching chamber 41.

In experiments, it has been shown that expectations were met, with this relatively simple apparatus.

We claim:

1. An apparatus for partially tempering rolled wire products made of steel from rolling heat comprising: a tubular quenching chamber having guide elements for guiding wire in a helical motion, and delivery means for delivery of a cooling medium to at least some helical courses of the guide elements comprising grooves disposed in a tubular wall of said quenching chamber, and further comprising an annular chamber for delivering the cooling medium to the grooves at at least one grove bottom edge.

2. An apparatus as defined by claim 1, wherein, as outer guide elements, grooves are present in the tubular wall of the quenching chamber, and the cooling medium is deliverable from an annular chamber to the grooves at at least one groove edge.

3. An apparatus as defined by claim 2, further comprising a core inside the quenching chamber having support elements for supporting the wire from the inside.

* * * * *